United States Patent [19]

Neki et al.

[11] Patent Number: 4,710,688

[45] Date of Patent: Dec. 1, 1987

[54] VARIABLE SPEED CONTROL WITH SELECTIVELY ENABLED COUNTER CIRCUITS

[75] Inventors: Shigeo Neki; Kenichi Ohara; Nobuho Shibata; Takashi Dohi, all of Osaka, Japan

[73] Assignee: Matsushita Electric Industrial Co., Ltd., Japan

[21] Appl. No.: 877,425

[22] Filed: Jun. 23, 1986

[30] Foreign Application Priority Data

Jun. 24, 1985 [JP] Japan ..... 60-137214

[51] Int. Cl.[4] ..... G05B 19/29

[52] U.S. Cl. ..... 318/603; 318/318

[58] Field of Search ..... 318/318, 326, 327, 328, 318/600, 603

[56] References Cited

U.S. PATENT DOCUMENTS

| | | | |
|---|---|---|---|
| 3,953,776 | 4/1976 | Wolf | 318/328 |
| 4,216,418 | 8/1980 | Wagensonner et al. | 318/318 |
| 4,386,301 | 5/1983 | Neki et al. | 318/318 |
| 4,556,001 | 12/1985 | Neki et al. | 318/318 |

*Primary Examiner*—William M. Shoop, Jr.

*Assistant Examiner*—D. Martin

*Attorney, Agent, or Firm*—Lowe, Price, LeBlanc, Becker & Shur

[57] ABSTRACT

In a sewing machine, a variable speed setting device generates a variable reference speed signal which is applied to a controller. A tachogenerator produces speed pulses at a frequency proportional to the speed of a motor which drives a needle armshaft. The speed pulses are counted during the interval between successive ones of low-frequency clock pulses and a first actual speed signal proportional to the speed of rotation of the motor is derived from the count. High-frequency clock pulses are counted during the interval between successive ones of the speed pulses and a second actual speed signal proportional to the speed of rotation of the motor is derived from the count. The first actual speed signal is enabled when the reference speed signal is higher than a predetermined value and the second actual speed signal enabled when the reference speed signal is lower than the predetermined value. The controller responds to the enabled signal by controlling the speed of the motor so that the enabled signal substantially equals the reference speed signal.

6 Claims, 4 Drawing Figures

VARIABLE SPEED CONTROL WITH SELECTIVELY ENABLED COUNTER CIRCUITS

BACKGROUND OF THE INVENTION

The present invention relates generally to sewing machines, and more particularly to a speed control circuit capable of generating a precision speed control signal over a wide range of speeds.

In a prior art speed control circuit of a sewing machine, as shown and described in U.S. Pat. No. 4,386,301 issued to Neki et al, a tachogenerator produces speed pulses at a frequency proportional to the rotational speed of a sewing machine motor having a brake-and-clutch arrangement. A variable frequency divider is provided to divide the frequency of the speed pulse by a factor which is in turn controlled by a reference speed signal supplied from a speed setting setting device, so that the frequency divider produces output pulses at a frequency which is a submultiple of the original frequency. The interval between successive ones of the output pulses is then measured and applied to a transfer circuit which transforms the measured interval according to a predetermined transfer function to control the brake-and-clutch arrangement with the transformed interval. Because of the closed loop operation, the measured interval approaches a constant value after the motor has attained a steady speed regardless of its value. While this prior art is advantageous for implementing the transfer circuit with a microprocessor, the motor speed tends to exihibit a stepwise variation corresponding to one pulse interval when the frequency dividing factor is changed in response to the resetting of the reference speed. Although the stepwise variation could be reduced by theoretically increasing the number of speed pulses generated for each revolution of the motor, there is a practical limit to the number of pulses to be generated.

SUMMARY OF THE INVENTION

It is therefore an object of the present invention to provide a sewing machine wherein the speed of a motor exhibits a minimum amount of stepwise variation.

Specifically, the sewing machine of the invention comprises a variable speed setting device for generating a variable reference speed signal and a tachogenerator for generating speed pulses at a frequency proportional to the speed of a motor which drives a needle armshaft. A first speed detector includes a first counter for counting the speed pulses during the interval between successive ones of low-frequency clock pulses and deriving from the count a first actual speed signal proportional to the speed of rotation of the motor. A second speed detector includes a second counter for counting high-frequency clock pulses during the interval between successive ones of the speed pulses and deriving from the count a second actual speed signal proportional to the speed of rotation of the motor. A speed control circuit is responsive to the first actual speed signal when the reference speed signal is higher than a predetermined value and responsive to the second actual speed signal from the second speed detector when the reference speed signal is lower than the predetermined value to control the rotational speed of the motor so that the actual speed signals substantially equal the reference speed signal.

BRIEF DESCRIPTION OF THE DRAWINGS

The present invention will be described in further detail with reference to the accompanying drawings, in which.

DETAILED DESCRIPTION

Figure 1:
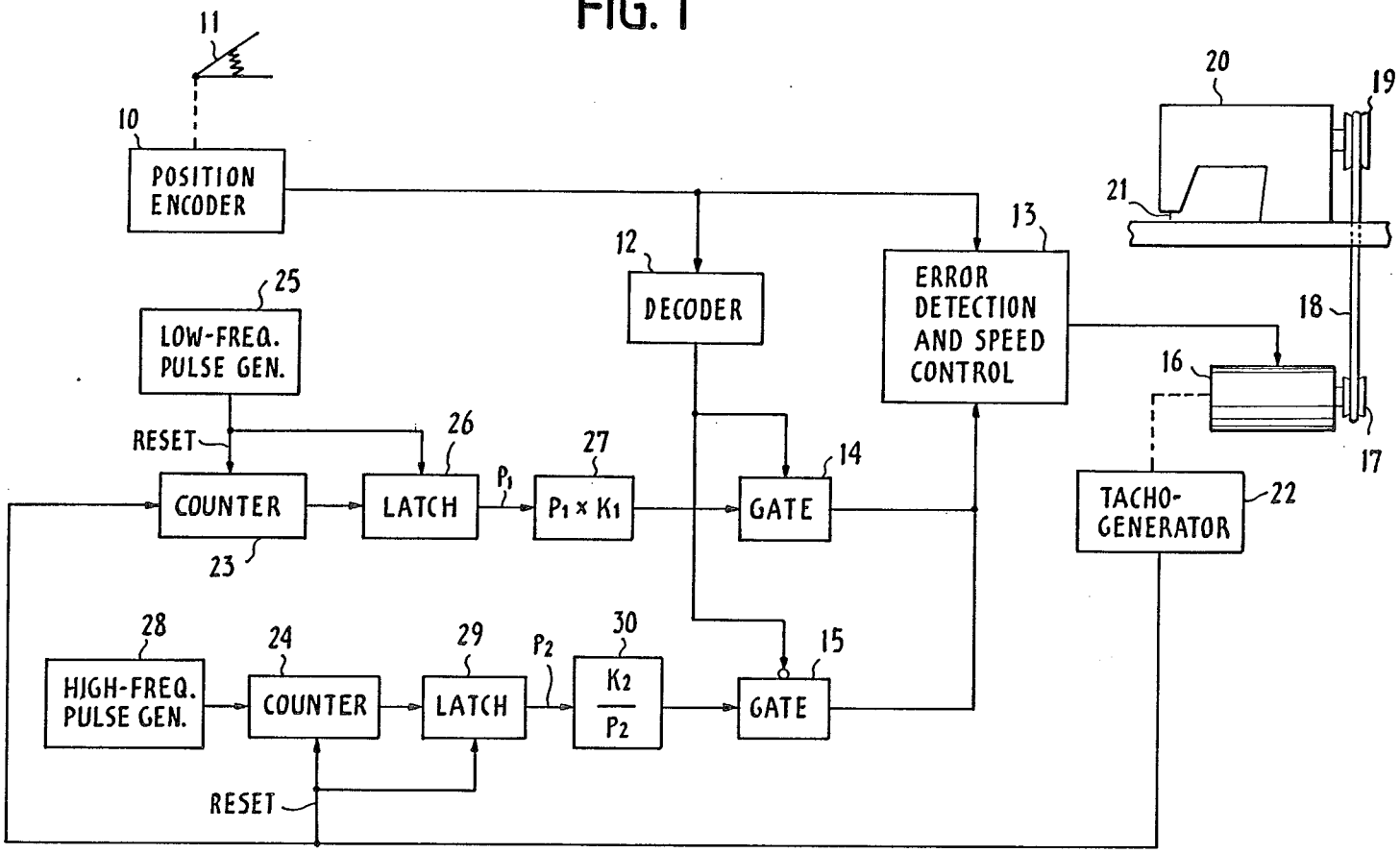
FIG. 1 is a block diagram of a sewing machine speed control circuit according to an embodiment of the present invention.

In FIG. 1, a sewing machine of the present invention comprises a position encoder 10 for detecting the amount of depression of a foot pedal 11 as an indication of a reference speed at which the sewing machine is to be operated. Encoder 10 generates a digital reference speed signal representative of that reference speed and applies it to a decoder 12 and an error detection and speed control circuit 13. Decoder 12 compares the reference speed signal with a predetermined threshold value and generates a logical 1 or 0 output depending on whether the reference signal is higher or lower than the threshold value, respectively, and supplies the logical output to gates 14 and 15 to selectively pass actual speed signals through the gates to control circuit 13. Error detection and speed control circuit 13 compares the selected actual speed signal with the reference speed signal and controls the speed of a sewing machine motor 16 so that the difference between the two input signals applied to controller 13 substantially reduces to zero. Motor 16 has a pulley 17 which is coupled by a belt 18 to a pulley 19 of a sewing machine armshaft 20 to reciprocate the needle 21.

A tachogenerator 22 is coupled to the motor 16 to generate a train of speed pulses at a frequency proportional to the speed of rotation of the motor and applies it to the count input of a first counter 23 and to the reset input of a second counter 24. A low-frequency pulse generator 25 is provided to generate sampling clock pulses at a frequency which is lower than the frequency of speed pulses from the tachogenerator 22 when the motor runs at a minimum speed. The low-frequency clock pulse is applied to the reset input of counter 23 to enable it to count the speed pulse and supplies a binary output $P_1$ proportional to the instantaneous speed value of the motor to a latch 26 in response to the low-frequency sampling pulses. The proportional speed value in latch 26 is therefore updated at constant intervals, the output of latch 26 being applied to a multiplier 27 which multiplies the instantaneous speed value $P_1$ with a constant $K_1$ to produce a first actual speed signal. The constant $K_1$ is appropriately selected so that the first actual speed signal varies in a range comparable with the reference speed signal. The output of multiplier 27 is applied to the error detection and speed control circuit 13 when the gate 14 is enabled in response to a logical 1 output of decoder 12.

Counter 24 is driven by a high-frequency pulse generator 28 at a frequency which is much higher than the highest frequency of the speed pulse with which it is reset. Counter 24 thus provides a count value $P_2$ which is inversely proportional to the instantaneous motor speed. A latch 29 is connected to the output of counter 24 to store the count value $P_2$. The inversely proportional speed value in latch 29 is thus updated at intervals variable as a function of the motor speed. The output of latch 29 is applied to a reciprocator 30 which provides a reciprocal of the instantaneous speed value $P_2$ and multiplies the reciprocal by a constant factor $K_2$ to produce a second actual speed signal which is proportional to the instantaneous motor speed. The constant $K_2$ is appropriately selected so that the second actual speed signal varies in a range comparable with the reference speed signal. The output of reciprocator 30 is applied to the error detection and speed control circuit 13 when the gate 15 is enabled in response to a logical 0 output from decoder 12

Consider now the amount of possible errors which are likely to be introduced to the actual speed signals at the inputs of gates 14 and 15.

In the case of the actual speed signal at the input of gate 14, an error occurs either when counter 23 fails to count one speed pulse which is to be counted or it counts an additional speed pulse which is not to be counted. Since the amount of error introduced to the input of gate 14 decreases nonlinearly with the motor speed as indicated by a curve H in FIG. 3. On the other hand, an error occurs in the input of gate 15 either when counter 24 fails to count one clock pulse from pulse generator 28 or counts an additional clock pulse. Since the reset interval of counter 24 is inversely proportional to the motor speed, the amount of error introduced to the input of gate 15 increases linearly as indicated by a line L in FIG. 2.

Figure 2:
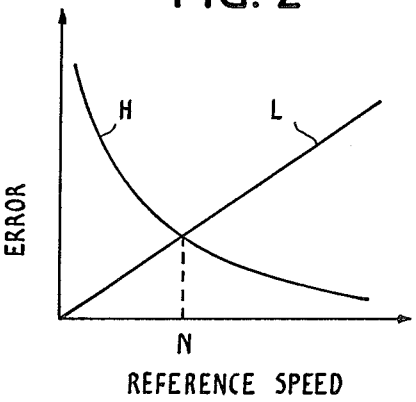
FIG. 2 is a graphic illustration of speed error as a function of reference speed according to the embodiment of FIG. 1.

It is seen from FIG. 2 that the amount of such errors can be reduced by exclusively enabling the gate 14 when the reference motor speed is higher than a speed value N which corresponds to the intersection of curves H and L and exclusively enabling the gate 15 when it is lower than the speed value N. Therefore, the decoder 12 compares the reference speed signal with a digital value representing the speed N and supplies a logical 1 or 0 output to gates 14 and 15 when the reference speed is higher or lower than the speed N to respectively pass the inputs of the gates 14 and 15 to control circuit 13.

Figure 3:
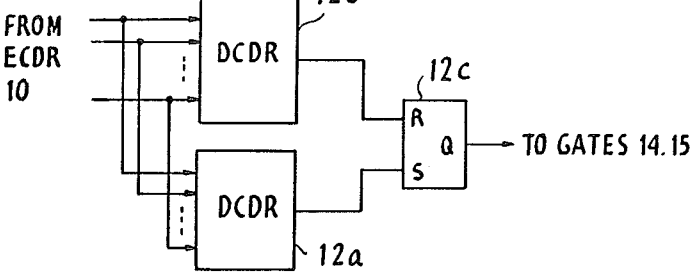
FIG. 3 is a circuit diagram of a modified form of the decoder of FIG. 1.
Figure 4:
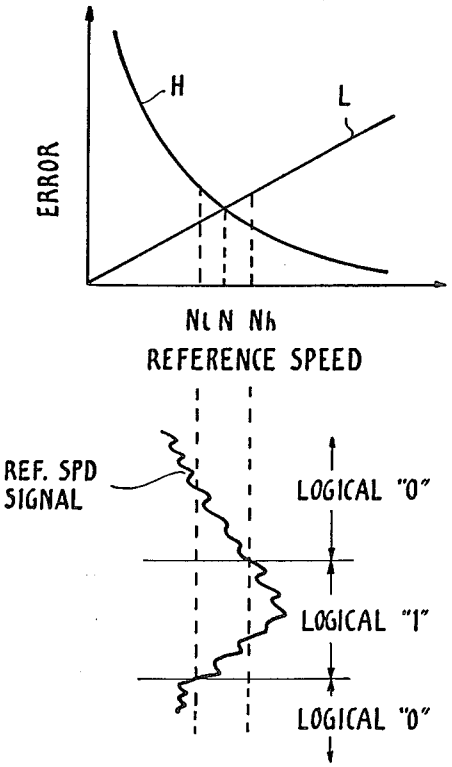
FIG. 4 is a graphic illustration of the speed error as a function of reference speed associated with the embodiment of FIG. 3.

It is preferred that the decoder 12 be provided with a hysteretic characteristic to avoid its threshold from being erratically crossed by the reference speed signal which fluctuates with mechanical vibrations inherent in the sewing machine. For this purpose, the decoder 12 is modified as shown in FIG. 3. A pair of decoders **12*a* and 12*b* are connected to the outputs of position encoder 11 to compare the reference speed signal with low and high threshold values Nl and Nh, respectively. Decoder 12*a* generates a logical 1 output when the reference speed signal is lower than the lower threshold value N; and decoder 12*b* generates a logical 1 output when the reference speed signal is higher than the higher threshold value Nh, and both decoders 12*a* and 12*b* generate a logical 0 output when the reference speed signal is between the low and high threshold values Nl and Nh. Between the low and high threshold values lies the threshold value N. The outputs of decoders 12*a* and 12*b* are applied to the set and reset inputs of a flip-flop 12*c*, respectively. The operation of the circuit of FIG. 3 will be visualized with reference to FIG. 4. If the fluctuating reference speed signal increases so that it crosses the low and high thresholds Nl and Nh when the flip-flop 12*c* is in a logical 0 output state, the output of flip-flop 12*c* switches to logical 1 at the first crossing of the higher threshold and if the signal subsequently decreases crossing the high and low thresholds in succession, the output of flip-flop 12*c*** remains at logical 1 until the second crossing of the lower threshold Nl.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A sewing machine having a motor for driving a needle armshaft, comprising:

means for generating a variable reference speed signal;

means for generating speed pulses at a frequency proportional to the rotational speed of said motor;

means for generating low-frequency clock pulses;

means for generating high-frequency clock pulses;

first speed detecting means including a first counter for counting said speed pulses during the interval between successive ones of said low-frequency clock pulses and deriving from the count a first actual speed signal proportional to the rotational speed of said motor;

second speed detecting means including a second counter for counting said high-frequency clock pulses during the interval between successive ones of said speed pulses and deriving from the count a second actual speed signal proportional to the rotational speed of said motor;

control means for controlling the rotational speed of said motor in response to a speed control signal applied thereto so that the speed control signal substantially equals the reference speed signal; and means for applying said first actual speed signal to said speed control means as said speed control signal when said reference speed signal is higher than a predetermined value and applying said second actual speed signal to said control means as said speed control signal when said reference speed signal is lower than said predetermined value.

2. A sewing machine as claimed in claim 1, wherein said applying means comprises means for comparing said reference speed signal with first and second predetermined threshold values, applying said first actual speed signal when said reference speed signal crosses said first and second predetermined threshold values in succession and applying said second actual speed signal when said reference speed signal crosses said second and first threshold values in succession.

3. A sewing machine as claimed in claim 1, wherein said second speed detecting means includes means for generating a reciprocal of the output of said second counter as said second actual speed signal.

4. A speed control circuit for a sewing machine having a motor for driving a needle armshaft, comprising:

means for generating a variable reference speed signal;

means for generating speed pulses at a frequency proportional to the rotational speed of said motor;

means for generating low-frequency clock pulses;

means for generating high-frequency clock pulses;

first speed detecting means including a first counter for counting said speed pulses during the interval between successive ones of said low-frequency clock pulses and deriving from the count a first actual speed signal proportional to the rotational speed of said motor;

second speed detecting means including a second counter for counting said high-frequency clock pulses during the interval between successive ones of said speed pulses and deriving from the count a second actual speed signal proportional to the rotational speed of said motor;

control means for controlling the rotational speed of said motor in response to a speed control signal applied thereto so that the speed control signal substantially equals the reference speed signal; and means for applying said first actual speed signal to said control means as said speed control signal when said reference speed signal is higher than a predetermined value and applying said second actual speed signal to said speed control means as said speed control signal when said reference speed signal is lower than said predetermined value.

5. A speed control circuit as claimed in claim 4, wherein said applying means comprises means for comparing said reference speed signal with first and second predetermined threshold values, applying said first actual speed signal when said reference speed signal crosses said first and second predetermined threshold values in succession and applying said second actual speed signal when said reference speed signal crosses said second and first threshold values in succession.

6. A speed control circuit as claimed in claim 1, wherein said second speed detecting means includes means for generating a reciprocal of the output of said second counter as said second actual speed signal.

* * * * *